United States Patent [19]

Shaffer

[11] Patent Number: 5,036,244

[45] Date of Patent: Jul. 30, 1991

[54] LIGHT-DIFFUSING COATING FOR A GLASS ELECTRIC LAMP BULB

[75] Inventor: John W. Shaffer, Danvers, Mass.

[73] Assignee: GTE Products Corporation, Danvers, Mass.

[21] Appl. No.: 453,524

[22] Filed: Dec. 20, 1989

[51] Int. Cl.[5] ..... H01J 5/16

[52] U.S. Cl. ..... 313/116; 313/117

[58] Field of Search ..... 313/112, 116, 117

[56] References Cited

U.S. PATENT DOCUMENTS

| | | | |
|---|---|---|---|
| 2,661,438 | 12/1953 | Shand . | |
| 2,922,065 | 1/1960 | Meister et al. . | |
| 2,963,611 | 12/1960 | Meister et al. . | |
| 2,988,458 | 6/1961 | Meister et al. . | |
| 3,175,117 | 3/1965 | Kardos | 313/116 |
| 3,842,306 | 10/1974 | Henderson et al. . | |
| 3,868,266 | 2/1975 | Henderson et al. . | |
| 3,909,649 | 9/1975 | Arsena | 313/112 |
| 4,081,709 | 3/1978 | Collins et al. . | |
| 4,099,080 | 7/1978 | Dawson et al. . | |
| 4,374,157 | 2/1983 | Barbier et al. . | |
| 4,438,152 | 3/1984 | Barbier et al. . | |
| 4,441,046 | 4/1984 | James . | |
| 4,441,047 | 4/1984 | Collins et al. . | |

FOREIGN PATENT DOCUMENTS

| | | |
|---|---|---|
| 56-41655 | 4/1981 | Japan . |

*Primary Examiner*—Donald J. Yusko
*Assistant Examiner*—John Giust
*Attorney, Agent, or Firm*—Joseph S. Romanow

[57] ABSTRACT

A glass electric lamp bulb, and an electric lamp, such as, for example, a tungsten halogen lamp, which includes such a lamp bulb, is provided. The inner surface of the lamp bulb includes a light-diffusing coating containing silica particles and a soluble silicate binder such as potassium silicate.

6 Claims, 1 Drawing Sheet

LIGHT-DIFFUSING COATING FOR A GLASS ELECTRIC LAMP BULB

BACKGROUND OF THE INVENTION

1. Field of the Invention

The present invention relates to a glass electric lamp bulb the inner surface of which has been coated to provide a low cost and environmentally safe diffusing coating having a visual appearance similar to that produced by conventional hydrofluoric acid etching.

2. Description of the Prior Art

For most lighting applications, it is desirable to provide some form of light diffusion in the outer bulb to reduce glare and produce a softer, more even illumination. Conventional incandescent lamps have a thin-walled outer bulb which is hermetically sealed to the bulb base in order to contain the inert gas fill which is the necessary environment for proper operation of the incandescent filament. One known method of providing the desired light diffusion in such a bulb has been by hydrofluoric acid etching or "frosting" of the inner surface of the bulb. This process is relatively costly, and causes special concern regarding the proper disposal of fluoride-containing waste.

Manufacturers of incandescent lamps have provided light diffusion by a "smoke" coating of the inner bulb surface with fumed silica. Fumed silica may comprise silicon dioxide formed, for example, by flame hydrolysis of silicon tetrachloride. The discrete particles formed thereby are extremely fine, having a diameter on the order of the wavelength of visible light. These "smoke" coatings tend to be white in appearance, and are somewhat less optically efficient than acid frosted bulbs, but they do alleviate the problem of hazardous waste disposal created by the acid process.

Manufacturers have made other attempts to overcome the problems incurred in providing light diffusion in bulbs. In U.S. Pat. No. 2,661,438 to Shand, which issued on Dec. 1, 1953, a mixture of alkaline-reacting silica aquasol and silica aerogel or silica xerogel is used for coating of incandescent lamp envelopes.

In U.S. Pat. No. 3,175,117 to Kardos, which issued on Mar. 23, 1965, floccular titanium dioxide, silicon dioxide or red iron oxide is mixed with granules of titanium dioxide in a solvent and applied to the inner bulb surface.

Silica is deposited on the inner surface of glass bulbs by the oxidation of silane with oxygen in U.S. Pat. Nos. 4,374,157 and 4,438,152 to Barbier et al, which issued on Feb. 15, 1983 and Mar. 29, 1984, respectively.

U.S. Pat. Nos. 2,963,611 and 2,922,065 to Meister et al., which issued on Dec. 6, 1960 and Jan. 19, 1960, respectively, teach that the addition of a limited amount of a finely-divided white material having a true density relatively high with respect to the density of silica will improve the adherence of the silica to the inner surface of the bulb. Such materials may include titania, barium titanate or zirconia.

The basic silica smoke process as described above is taught in U.S. Pat. No. 2,988,458 to Meister et al., which issued on June 13, 1961.

A similar smoke process is disclosed in U.S. Pat. No. 4,099,080 to Dawson et al., which issued on July 4, 1978. Improved adherence and freedom from agglomerations of the silica are provided by utilizing a mixture of hydrophilic silica and hydrophobic silica.

More effective light scattering by the silica coating is provided by the addition of a thin layer of spherical alumina particles in U.S. Pat. Nos. 3,842,306 and 3,868,266 to Henderson et al, which issued on Oct. 15, 1974 and Feb. 25, 1975, respectively.

In U.S. Pat. No. 3,909,649 to Arsena, which issued on Sept. 30, 1975, control of the size of the silica particles and the use of a polyacrylic acid binder in an ammoniacal water solution results in yet another improvement in the silica coating process.

The electrostatic coating processes taught by Collins and James in U.S. Pat. Nos. 4,081,709, 4,441,046 and 4,441,047, which issued on Mar. 28, 1978 and Apr. 3, 1984, respectively, illustrate still further attempts to improve upon the basic silica smoke coating process.

Recent developments in the lighting field have led to increased use of tungsten halogen lamps. Such lamps generally utilize a relatively heavy or thick outer bulb or envelope which is designed to contain any glass fragments in the event of rupture of the inner tungsten halogen capsule, which may operate with a hot fill pressure of ten atmospheres or more.

These heavy-walled, molded bulbs tend to have somewhat nonuniform glass thickness as well as surface marks such as mold closure lines, and the application of a white interior diffusing coating such as the silica coatings described above produces an objectionable appearance which accentuates the bulb thickness and reveals all nonuniformities and marks. Additionally, since the outer bulbs of tungsten halogen lamps are not hermetically sealed, ambient atmospheric moisture tends to diminish the adherence of silica coatings to the inner surface of the bulb, and mechanical shock and vibration can cause detachment of the silica particles.

In contrast, when the acid etch process is used on the inner surface of the outer bulb of a tungsten halogen lamp, a rough surface texture which is optically integral with the glass is created, which texture tends to conceal both the thickness and nonuniformity of the bulb wall, as well as exterior surface marks such as mold lines. However, as noted such a process is environmentally hazardous.

The prior art does not provide a light diffusing coating on the inner surface of a bulb for a tungsten halogen lamp or the like which is operationally effective, aesthetically pleasing and can be applied in a manner which is environmentally safe. It is an object of the present invention to provide a glass electric lamp bulb such as, for example, a bulb for use in a tungsten halogen lamp, having a light-diffusing coating which overcomes these problems.

SUMMARY OF THE INVENTION

This invention achieves these and other results by providing a glass electric lamp bulb which has an inner surface having a light-diffusing coating of silica particles and a soluble silicate binder such as, for example, potassium silicate. It has been observed that a lamp coating comprising silica particles which have been bonded to the inner surface of the bulb by a soluble silicate such as potassium silicate provides a visual appearance as well as optical properties which are essentially indistinguishable from that obtained by acid etching. Such a lamp is operationally effective and aesthetically pleasing yet the processing of the lamp does not produce any environmentally unsafe or hazardous waste by-products.

DESCRIPTION OF THE PREFERRED EMBODIMENT

Figure 1:
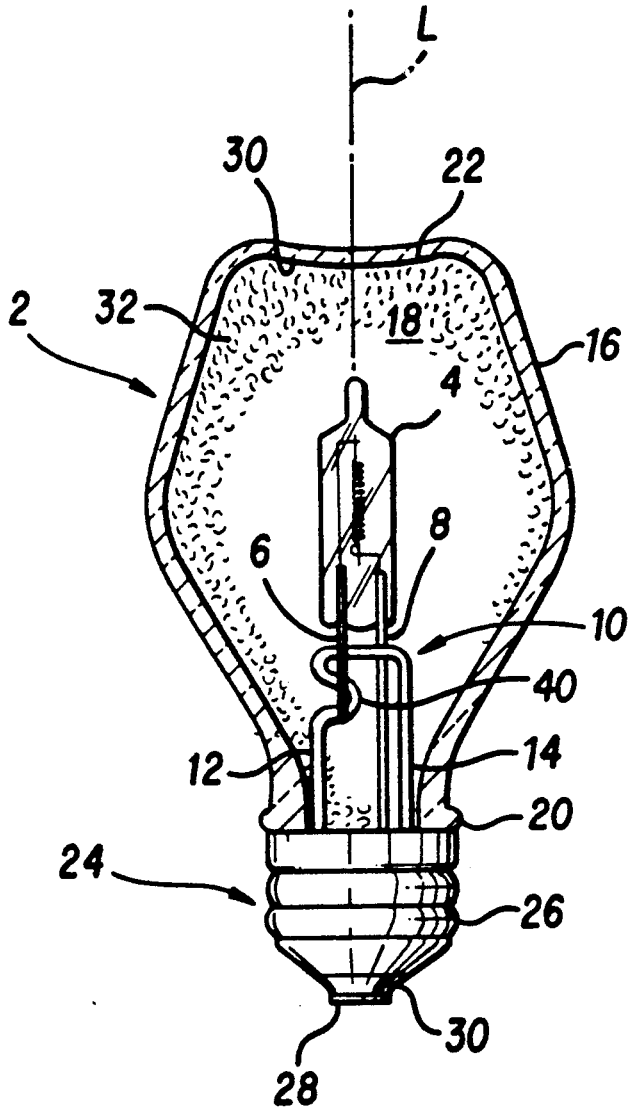
FIG. 1 shows an electric lamp particularly suited for achieving the objects of this invention.

The embodiment of this invention which is illustrated in FIG. 1 is particularly suited for achieving the objects of this invention. FIG. 1 depicts an electric lamp which includes a sealed inner envelope means for converting electrical energy into light. In the embodiment of FIG. 1, the electric lamp is, without limitation, a tungsten halogen lamp 2 having a longitudinal axis L, and the sealed inner envelope means is a conventional tungsten-halogen incandescent capsule 4. Such inner envelope means includes a first capsule lead 6 and a second capsule lead 8 each of which extend from the tungsten-halogen capsule 4. As depicted in the drawings a tungsten filament extends in capsule 4 between the internal terminations of the leads 6 and 8.

The lamp 2 is provided with a wire support frame 10. The capsule lead 6 is electrically connected to wire support frame 10 and the inner envelope lead 8 is spaced from the wire support frame 10. In the embodiment of FIG. 1 the wire support frame 10 includes a first leg 12 and a second leg 14, lead 6 being electrically connected and structurally connected to the first leg 12 as, for example, by being welded thereto.

Lamp 2 also includes a light-transmissive outer envelope 16 forming a cavity 18 therein and having a neck portion 20 and an opposite dome portion 22. A lamp base 24 is connected to the neck portion 20 of the outer envelope 16. In particular, lamp base 24 includes an electrically conductive first region and an electrically conductive second region insulated therefrom. In the preferred embodiment, as depicted to FIG. 1, the electrically conductive first region includes a conventional threaded metal shell 26 and the electrically conductive second region includes a metal eyelet 28. An insulating means such as a glass insulator 30 is provided between the metal shell 26 and the metal eyelet 28. The lead 6 is electrically coupled to the wire support frame 10 which is electrically connected to the threaded metal shell 26. The lead 8 is electrically connected to the metal eyelet 28.

Legs 12 and 14 extend into the cavity 18 to support the sealed tungsten-halogen capsule 4 within the cavity. The threaded metal shell 26 is attached to the neck portion in a conventional manner. For example, base 24 can be a "push-on" type or a "screw-on" type as fully described in U.S. Pat. No. 4,647,809 to Blaisdell et al. and assigned to the assignee. This patent describes a conventional tungsten-halide lamp.

The lamp thus far described is representative, without limitation, of a conventional tungsten halogen lamp. Such lamps typically include an outer envelope 16 which is a relatively heavy or thick bulb having a somewhat nonuniform glass thickness and surface marks such as mold closure lines. Outer envelope 16 also typically includes an inside surface 30 having a diffusing coating 32 applied thereto. The object of the coating 32 is to provide light diffusion in the outer bulb to reduce glare and produce a softer, more even illumination.

The present invention is directed to such a diffusion coating. In particular, a light-diffusing coating 32 is provided comprising a suspension of silica particles and a soluble silicate binder. In the preferred embodiment the soluble silicate binder is, without limitation, potassium silicate. The coating can be applied in a conventional manner.

In order to avoid any tendency for nonuniform areas to form in the coating during the drying process as a result of the formation of small agglomerates of silica particles, a dispersing agent can be added to the suspension. In the preferred embodiment, the dispersing agent is fumed aluminum oxide. It will be apparent that other wetting or dispersing agents can be used. However, an inorganic material such as fumed alumina is preferred so that the coating does not discolor as a result of the rise in temperature during operation of the lamp. One possible dispersing agent is Aluminum Oxide C, a product sold by Degussa Inc., Pigments Division, of Teterboro, N.J.

In one embodiment of the present invention the inside surface of a molded lime glass bulb used in a GTE Sylvania tungsten halogen lamp was coated as described herein. In particular a light-diffusing coating solution was prepared by forming a suspension of 4.0 grams of 1.1 micron milled crystalline $SiO_2$; 10.0 ml of potassium silicate solution; and 10.0 ml of deionized water. The 1.1 micron milled crystalline $SiO_2$ used was Min-U-Sil 5, a product sold by U.S. Silica Company of Berkeley Springs, W. Va. The potassium silicate solution used was Kasil 42, a product sold by PQ Corporation of Valley Forge, Pa. The suspension was poured into the molded lime glass bulb. The suspension was swirled in order to wet the entire inner surface of the bulb. The suspension was then poured out of the bulb, and the bulb was drained and dried. Upon drying, the coating gave a diffusing appearance similar to a prior art acid frosted bulb.

It will be apparent to those skilled in the art that the present invention is not limited to the use of 1.1 micron milled crystalline $SiO_2$. For example, other forms of silica can be used such as, without limitation, precipitated silicas and glass powder. Similarly, while a particle size of about one micron was used in the above example, silica particles having a mean particle size within the range from 0.1 to 10.0 microns can be used depending upon the visual appearance desired.

Similarly, the present invention is not limited to Kasil 42-type soluble potassium silicate. Other soluble silicate binders can be used. However, potassium silicate is preferred over sodium silicate because dried films of sodium silicate tend to "weather" and form a white surface haze of sodium carbonate upon aging in contact with the atmosphere. This can be a particular problem with a conventional tungsten halogen lamp the outer envelope of which is not sealed.

The actual quantity of potassium silicate binder solids used relative to the weight of silica particles in the coating dispersion will affect the appearance and degree of translucency of the dried coating. It will be noted that in the specific embodiment discussed herein an acceptable coating was obtained by combining 10.0 ml of potassium silicate solution with 4.0 grams of 1.1 micron milled crystalline $SiO_2$. However, the quantity of binder used for the particular particle size of silica chosen can be adjusted so that the silica particles project through the binder film and form a rough, light diffusing surface much like that resulting from chemical etching of the glass. For example, the finer the silica particles, the lower will be the binder weight ratio.

The silica particles combined with a soluble silicate binder such as, for example, potassium silicate provide a diffusing coating particularly useful in coating the inside surface of the heavy-walled molded bulbs used to form tungsten halogen lamps. The coating of the present invention visually appears like a chemically etched "frost" and tends to conceal bulb wall thickness nonuniformity and bulb glass surface marks. These benefits are obtained with the added advantage that a low cost coating is provided which is environmentally safe to effect.

The embodiments which have been described herein are but some of several which utilize this invention and are set forth here by way of illustration but not of limitation. It is apparent that many other embodiments which will be readily apparent to those skilled in the art may be made without departing materially from the spirit and scope of this invention.

I claim:

1. A light diffusing outer envelope for a double enveloped tungsten halogen lamp, said outer envelope comprising:

(a) a molded light-transmissive glass body enclosing a cavity, said body having an interior surface substantially surrounding said cavity; and (b) a light diffusing coating on said interior surface, said coating including silica particles and potassium silicate.

2. A light diffusing outer envelope for a double enveloped lamp as described in claim 1 wherein said light diffusing coating further includes fumed aluminum oxide.

3. A light diffusing outer envelope for a double enveloped lamp as described in claim 1 wherein said silica particles have a mean particle size within the range from about 0.1 to about 10.0 microns.

4. A tungsten halogen lamp comprising:

(a) an outer envelope including a molded light-transmissive glass body enclosing a cavity, said body having an interior surface substantially surrounding said cavity and a light diffusing coating on said interior surface, said coating including silica particles and potassium silicate;

(b) a tungsten halogen light source capsule mounted within said cavity, said capsule having two electrical lead-in wires;

(c) a base mounted on said outer envelope, said base having two electrical poles, each of said poles being electrically coupled with one of said lead-in wires; and (d) means for electrically and mechanically completing said lamp.

5. A tungsten halogen lamp as described in claim 4 wherein said light diffusing coating further includes fumed aluminum oxide.

6. A tungsten halogen lamp as described in claim 4 wherein said silica particles have a mean particle size within the range from about 0.1 to about 10.0 microns.

* * * * *